US010326225B2

(12) United States Patent
Ju

(10) Patent No.: US 10,326,225 B2
(45) Date of Patent: Jun. 18, 2019

(54) ELECTRICAL CONNECTOR AND TERMINAL

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/920,817

(22) Filed: Mar. 14, 2018

(65) Prior Publication Data

US 2018/0269613 A1 Sep. 20, 2018

Related U.S. Application Data

(60) Provisional application No. 62/505,206, filed on May 12, 2017.

(30) Foreign Application Priority Data

Mar. 14, 2017 (CN) ..... 2017 1 0149892
Nov. 3, 2017 (CN) ..... 2017 1 1067354

(51) Int. Cl.
*H01R 12/70* (2011.01)
*H01R 12/71* (2011.01)
*H01R 13/24* (2006.01)

(52) U.S. Cl.
CPC ..... *H01R 13/2492* (2013.01); *H01R 12/7076* (2013.01); *H01R 12/714* (2013.01); *H01R 13/2435* (2013.01)

(58) Field of Classification Search
CPC .. H01R 12/7076; H01R 12/714; H01R 12/52; H01R 13/2435; H01R 13/2492
See application file for complete search history.

(56) References Cited

U.S. PATENT DOCUMENTS 5,152,695 A 10/1992 Grabbe et al.
5,632,631 A * 5/1997 Fjelstad ..... G01R 1/0466 257/E23.067

(Continued)

FOREIGN PATENT DOCUMENTS

CN 2770129 Y 4/2006
CN 2840357 Y 11/2006

(Continued)

*Primary Examiner* — Briggitte R. Hammond

(74) *Attorney, Agent, or Firm* — Locke Lord LLP; Tim Tingkang Xia, Esq.

(57) ABSTRACT

An electrical connector is configured to electrically connect to a chip module, where a bottom surface of the chip module is provided with at least one conductive sheet. The electrical connector includes: an insulating body, configured to sustain the chip module, and provided with at least one accommodating hole penetrating through the insulating body vertically; and at least one terminal, correspondingly accommodated in the at least one accommodating hole, and having at least two elastic arms. Two inner sides of two adjacent elastic arms of the at least two elastic arms are protrudingly provided with two contact portions upward, so that each of the contact portions is located higher than an upper surface of each of the two adjacent elastic arms. An outer side of each elastic arm is spaced from each of the contact portions. The two contact portions upward abut a same conductive sheet of the chip module.

20 Claims, 22 Drawing Sheets

(56) References Cited

U.S. PATENT DOCUMENTS 6,616,485 B2 * 9/2003 Harasawa ..... H01R 13/2442 439/630
6,888,362 B2 * 5/2005 Eldridge ..... G01R 1/0483 257/E23.078
6,942,495 B2 * 9/2005 Liao ..... H01R 13/2435 439/66
7,435,100 B2 * 10/2008 Chang ..... H01R 13/2435 439/66
7,625,217 B1 * 12/2009 Liao ..... H01R 12/714 439/66
7,791,443 B1 * 9/2010 Ju ..... H01R 12/52 336/107
7,972,144 B2 * 7/2011 Chang ..... H01R 4/02 439/66
7,988,501 B2 * 8/2011 Chang ..... H05K 7/1069 439/751
8,167,664 B2 * 5/2012 Ju ..... H01R 13/11 439/733.1
8,323,038 B2 * 12/2012 Jin ..... H01R 12/714 439/66
8,821,198 B2 * 9/2014 Harada ..... H01R 12/57 439/66
8,911,242 B2 * 12/2014 Jeon ..... H01R 13/2442 439/66
8,926,338 B2 * 1/2015 Kiryu ..... H01R 13/24 439/66
2007/0178719 A1 * 8/2007 Mendenhall ..... H01R 12/57 439/66
2008/0160841 A1 * 7/2008 Polnyi ..... H01R 13/2435 439/842
2009/0035995 A1 * 2/2009 Chang ..... H01R 13/2492 439/630
2009/0253287 A1 * 10/2009 Polnyi ..... H01R 13/2435 439/331
2010/0062620 A1 * 3/2010 Lei ..... H01R 13/2442 439/66
2016/0087360 A1 * 3/2016 Walden ..... H01R 12/7082 439/66

FOREIGN PATENT DOCUMENTS

CN 101087047 A 12/2007
CN 201616527 U 10/2010

* cited by examiner

2

100

2

ELECTRICAL CONNECTOR AND TERMINAL

CROSS-REFERENCE TO RELATED PATENT APPLICATION

This non-provisional application claims priority to and the benefit of, under 35 U.S.C. § 119(e), U.S. provisional patent application Ser. No. 62/505,206, filed May 12, 2017, and under 35 U.S.C. § 119(a), patent application Serial No. CN201710149892.5 filed in China on Mar. 14, 2017 and patent application Serial No. CN201711067354.8 filed in China on Nov. 3, 2017. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and terminals, and in particular, to a land grid array electrical connector and terminals that are configured to electrically connect a chip module onto a circuit board.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Chinese Patent No. 200420054523.6 discloses an electrical connector that includes an insulating body provided with accommodating holes, and conductive terminals accommodated in the accommodating holes and configured to conduct a chip module with a circuit board. Each conductive terminal mainly includes a main body portion and arm portions provided at upper and lower sides of the main body portion and extending obliquely. An end of each arm portion is provided with a contact portion conducted with an electronic element. At least one side of the main body portion is provided with two arm portions, thereby ensuring better electrical conduction performance between the terminals of the electrical connector and the chip module or the circuit board.

However, the electrical connector has at least the following disadvantages. Because the chip module has a manufacturing tolerance, the circular conductive sheets at a bottom surface of the chip module have differences in heights, so that a part of the conductive sheets is higher than other components around them. A contact area between each of the contact portions and the chip module is large, and a height of each contact portion is the same in a direction from inside to outside, so that when the terminals are pressed by the chip module, an outer side of each contact portion is relatively far away from a center of the corresponding conductive sheet, and therefore the contact portion may easily slide out from the conductive sheet of the chip module and abut other components that are on the chip module and located lower than the conductive sheet, resulting in a problem that the conductive terminals and the chip module are not conducted with each other because the contact portions are out of contact the conductive sheet.

Therefore, a heretofore unaddressed need to design a new electrical connector exists in the art to address the aforementioned deficiencies and inadequacies.

SUMMARY

In view of the problem addressed in the background technology, an objective of the present invention is to provide an electrical connector, where the terminals of the electrical connector cannot easily leave corresponding conductive sheets of a chip module.

To achieve the foregoing objective, the present invention adopts the following technical solutions.

An electrical connector, configured to electrically connect to a chip module, wherein a bottom surface of the chip module is provided with at least one conductive sheet, the electrical connector including: an insulating body, configured to sustain the chip module, and provided with at least one accommodating hole penetrating through the insulating body vertically; and at least one terminal, correspondingly accommodated in the at least one accommodating hole, and having at least two elastic arms, wherein two inner sides of two adjacent elastic arms of the at least two elastic arms are protrudingly provided with two contact portions upward, so that each of the contact portions is located higher than an upper surface of each of the two adjacent elastic arms, an outer side of each of the two adjacent elastic arms is spaced from each of the contact portions, and the two contact portions upward abut a same conductive sheet of the at least one conductive sheet.

In certain embodiments, each of the two adjacent elastic arms has a center line along an extending direction thereof, and each of the contact portions is provided at one side of the center line.

In certain embodiments, the electrical connector includes a plurality of terminals, wherein the two adjacent elastic arms is provided at two of the terminals.

In certain embodiments, each of the terminals has a flat plate-shaped connecting portion; the two adjacent elastic arms are formed by bending and extending upward from the connecting portion; two conducting arms are formed by bending and extending downward from the connecting portion; inner sides of the two conducting arms are protrudingly provided with two abutting portions downward, so that each of the abutting portions is located lower than a lower surface of each of the conducting arms; an outer side of each of the conducting arms is spaced from each of the abutting portions; and the two abutting portions downward abut a same conductive spacer of a circuit board.

In certain embodiments, each of the abutting portions and each of the contact portions have a same structure.

In certain embodiments, a flat plate-shaped retaining portion is formed by extending from each of two opposite sides of the connecting portion, each of two opposite sides of each accommodating hole is concavely provided with a retaining groove, and the retaining groove has a stopping surface located below the retaining portion to prevent each of the terminals from moving downward.

In certain embodiments, each of the conducting arms has a center line along an extending direction thereof, and each of the abutting portions is provided at one side of the center line.

In certain embodiments, a contour of each of the contact portions is a semicircle.

In certain embodiments, a height of each of the contact portions gradually decreases along a direction from the inner side of corresponding elastic arm to the outer side of corresponding elastic arm.

In certain embodiments, the inner side of each of the two adjacent elastic arms is flush with an inner side of each of the contact portions.

In certain embodiments, each of the contact portions extends to an end of each of the two adjacent elastic arms.

In certain embodiments, at least one of the two adjacent elastic arms is bent toward another one of the two adjacent elastic arms, so that a distance between the two adjacent elastic arms decreases in a direction from bottom to top.

Compared with the related art, the electrical connector according to certain embodiments of the present invention has the following beneficial effects.

Two contact portions are upward protrudingly provided at the inner sides of the two adjacent elastic arms and abut the same conductive sheet. Therefore, a contact area between each terminal and the conductive sheet is small, so as to ensure that the contact portions cannot easily leave the conductive sheet, thereby preventing the contact portions from being out of contact with the conductive sheet to avoid the outer side of each contact portion sliding out from the conductive sheet and abutting other components that are on the chip module and that are lower than the conductive sheet. Therefore, a risk that the terminals and the chip module are not conducted with each other is reduced, thereby ensuring stable contact between the electrical connector and the chip module.

To achieve the foregoing objective, the present invention further adopts the following technical solutions.

A terminal, configured to electrically connect to a chip module, wherein multiple conductive sheets are provided on a bottom surface of the chip module, the terminal including: two elastic arms, wherein two adjacent inner sides of the two elastic arms are provided with two contact portions, the two contact portions upward abut a same conductive sheet of the conductive sheets, opposite outer sides of the two elastic arms are provided with two notches respectively, and the two notches are respectively connected to the two contact portions.

In certain embodiments, each of the two elastic arms has a center line along an extending direction thereof, and each of the contact portions is provided at one side of the center line.

In certain embodiments, at least one of the two elastic arms is bent toward another one of the two elastic arms, so that a distance between the two elastic arms decreases in a direction from bottom to top.

In certain embodiments, each of the notches penetrates through the corresponding elastic arm to an end of the corresponding elastic arm.

In certain embodiments, each of the contact portions extends to the end of the corresponding elastic arm.

In certain embodiments, each of the notches penetrates through the corresponding elastic arm in a vertical direction.

In certain embodiments, a bottom surface of each of the notches is inclined to an upper surface of the corresponding contact portions.

In certain embodiments, the two elastic arms are folded outward to form the two contact portions.

Compared with the related art, the terminal according to certain embodiments of the present invention has the following beneficial effects.

Two contact portions are upward protrudingly provided at the inner sides of the two elastic arms of each terminal and abut the same conductive sheet, and the opposite outer sides of the two adjacent elastic arms are provided with two notches that are respectively connected to the two contact portions. Therefore, a contact area between the terminal and the conductive sheet is small, so as to ensure that the contact portions cannot easily slide out the conductive sheet, thereby preventing the contact portions from being out of contact with the conductive sheet to avoid the outer side of each contact portion sliding out from the conductive sheet and abutting other components that are on the chip module and that are lower than the conductive sheet. Therefore, a risk that the terminal and the chip module are not conducted with each other is reduced.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
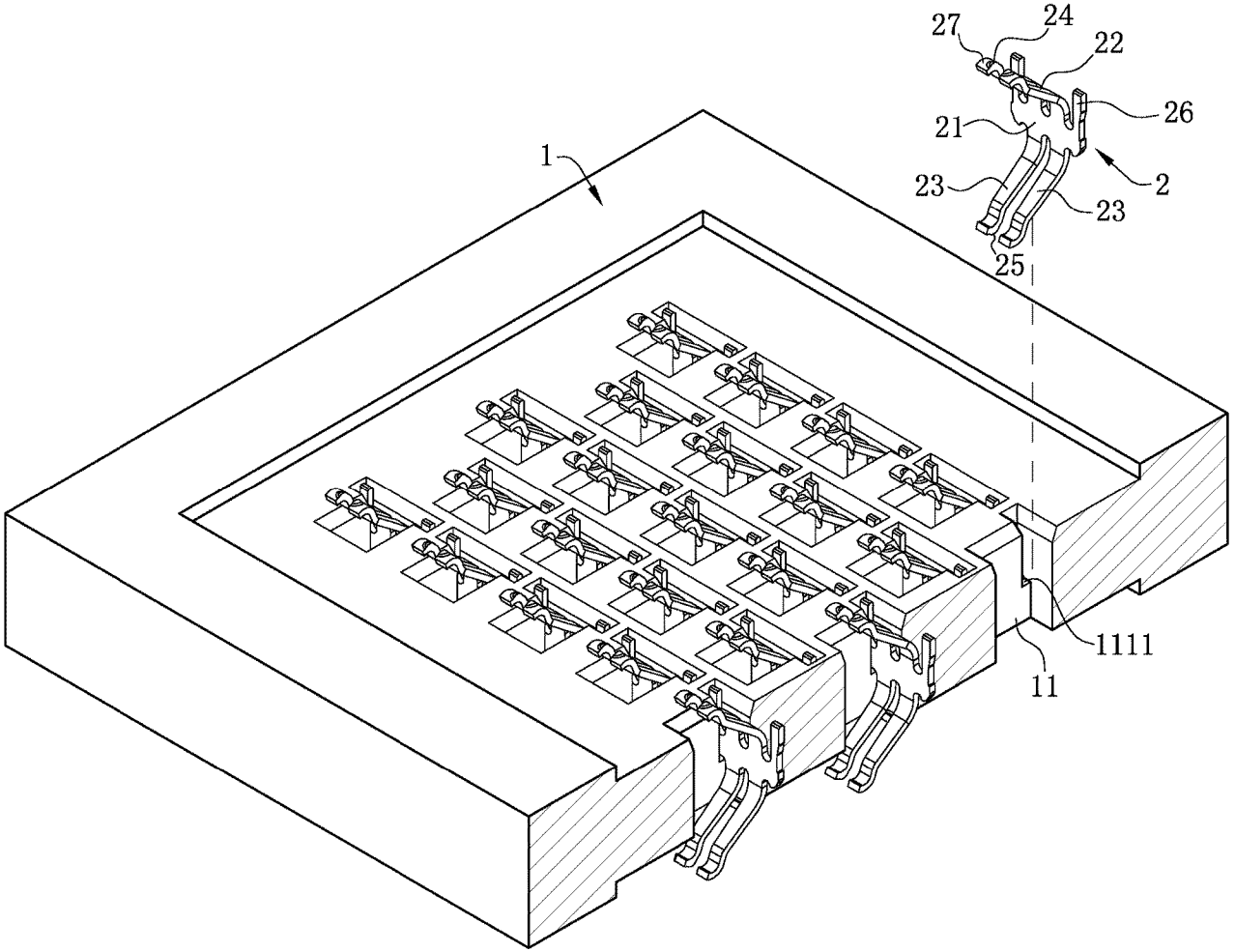
FIG. 1 is a perspective view of an electrical connector according to a first embodiment of the present invention.
Figure 2:
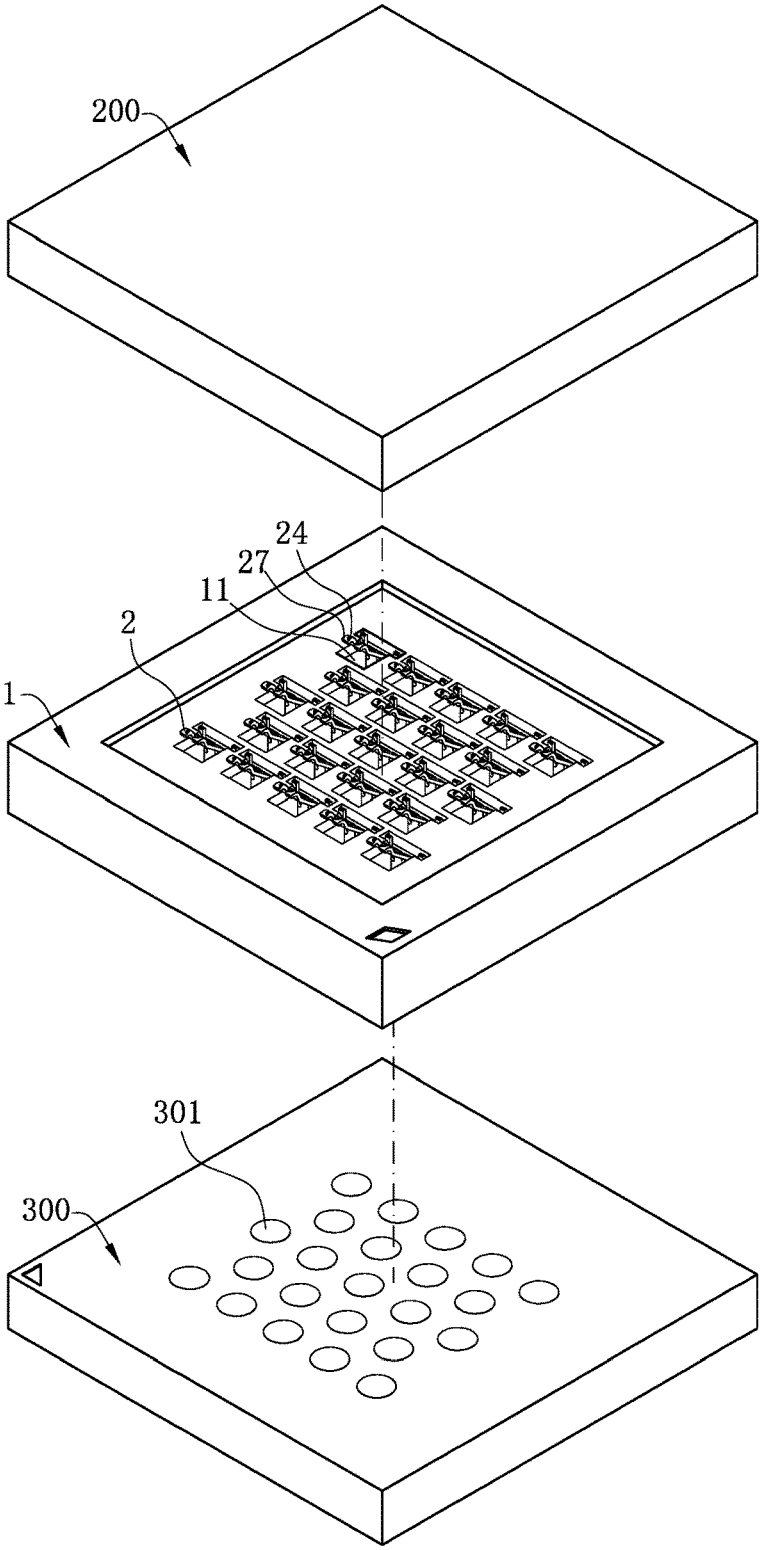
FIG. 2 is a perspective view of the electrical connector in FIG. 1 before a chip module is pressed thereon.
Figure 3:
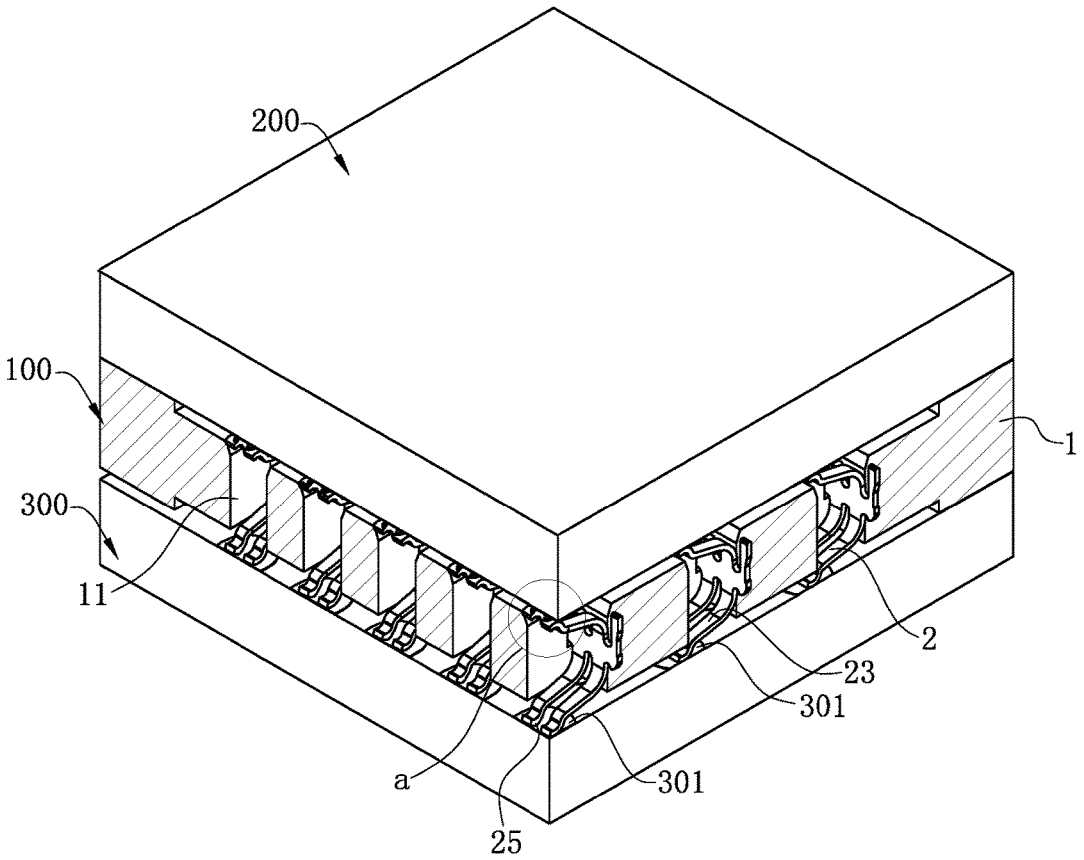
FIG. 3 is a perspective cross-sectional view of the electrical connector in FIG. 1 after a chip module is pressed thereon.
Figure 4:
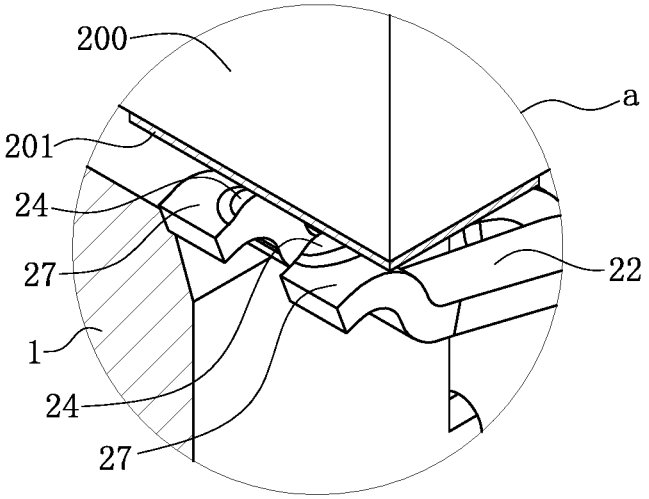
FIG. 4 is an enlarged view of a part a in FIG. 3.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-22. In accordance with the purposes of this invention, as embodied and broadly described herein, this invention, in one aspect, relates to an electrical connector.

FIG. 1 to FIG. 11 show an electrical connector 100 according to a first embodiment of the present invention. The electrical connector 100 is configured to electrically connect a chip module 200 to a circuit board 300, and includes an insulating body 1 and multiple terminals 2 accommodated in the insulating body 1.

Figure 8:
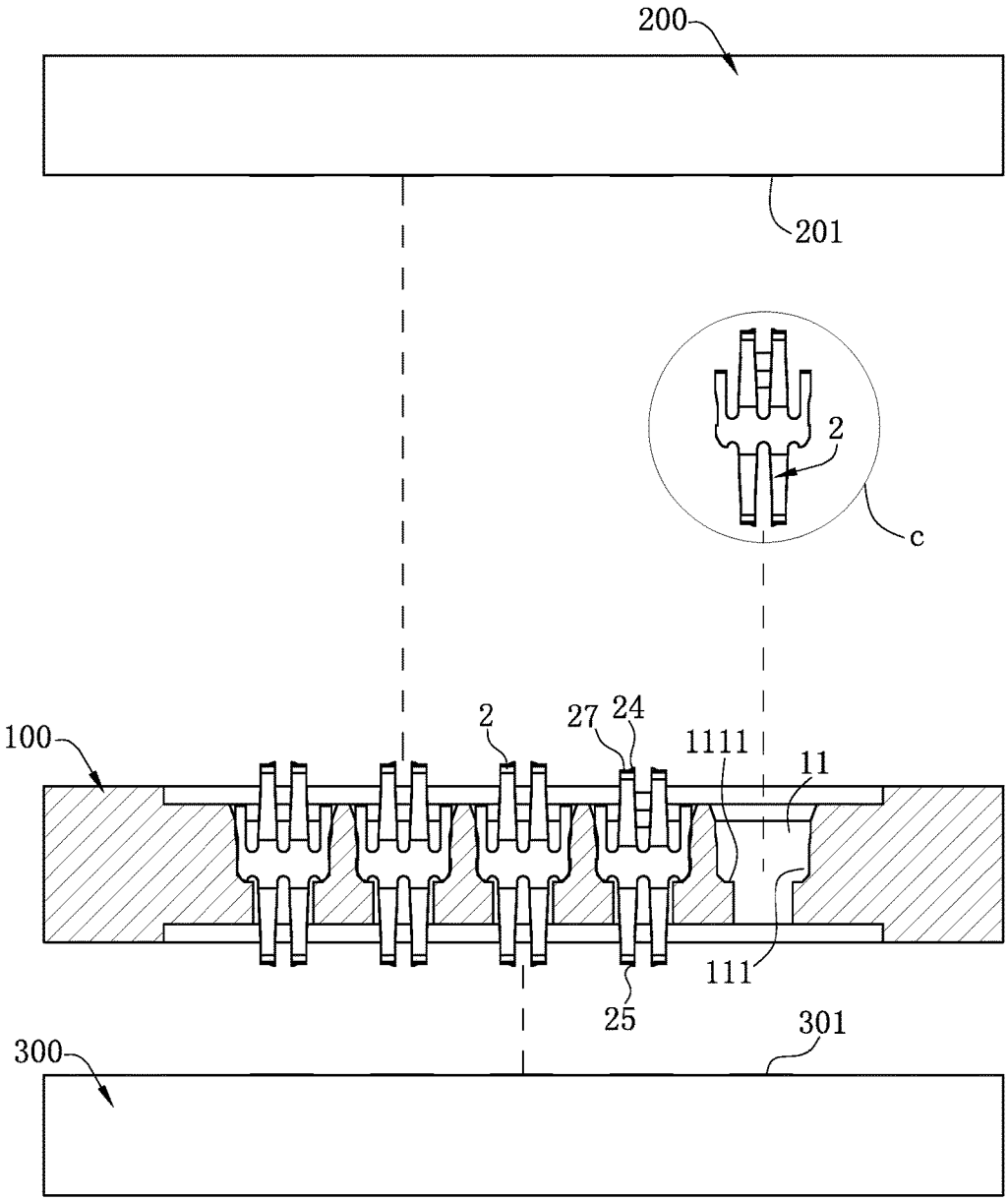
FIG. 8 is a side view of the electrical connector in FIG. 1 before a chip module is pressed thereon.
Figure 9:
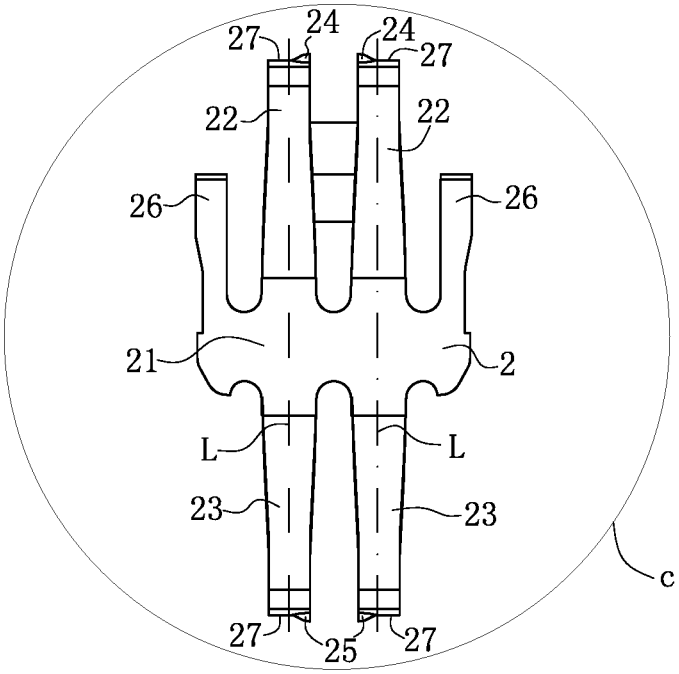
FIG. 9 is an enlarged view of a part c in FIG. 8.
Figure 10:
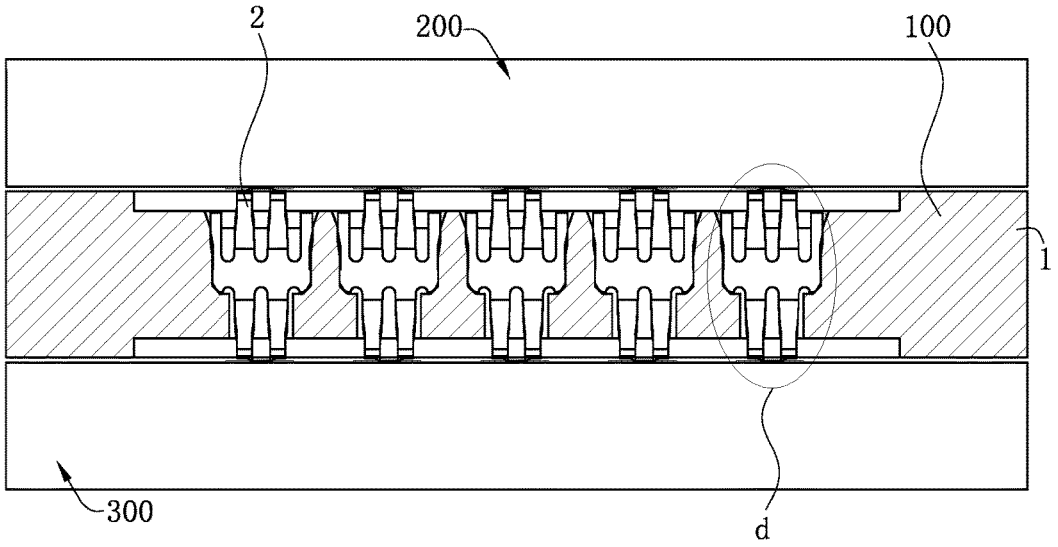
FIG. 10 is a side view of the electrical connector in FIG. 1 after a chip module is pressed thereon.

As shown in FIG. 1 and FIG. 8, the insulating body 1 has multiple accommodating holes 11 penetrated through the insulating body 1 vertically. The accommodating holes 11 are disposed in rows in a staggered manner. Each of two opposite sides of each of the accommodating holes 11 is concavely provided with a retaining groove 111, and each of the retaining grooves 111 has a stopping surface 1111.

The terminals 2 are respectively and correspondingly accommodated in the accommodating holes 11.

Figure 5:
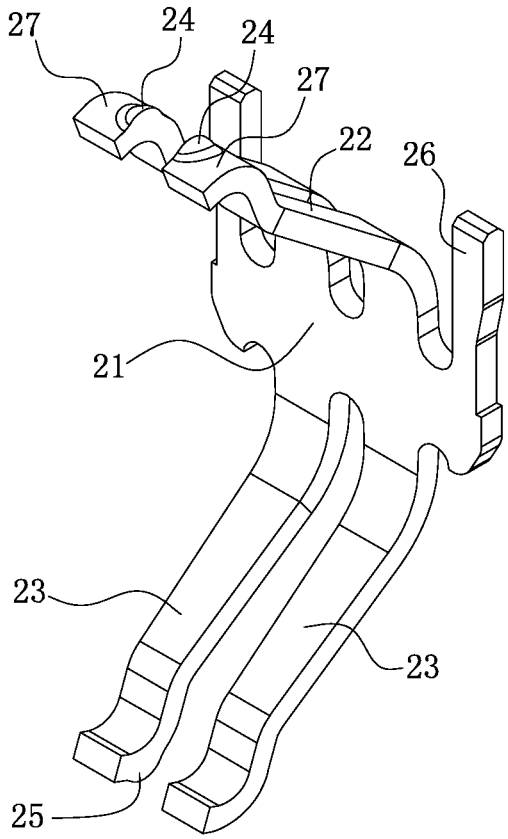
FIG. 5 is a perspective view of a terminal in FIG. 1.
Figure 6:
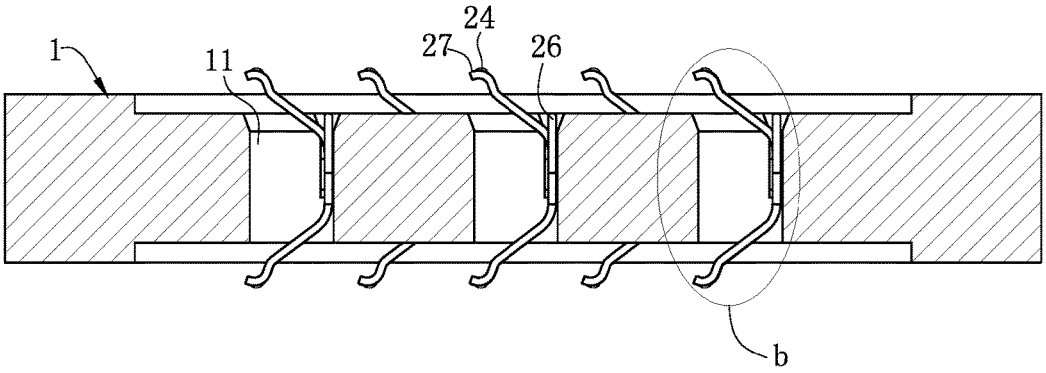
FIG. 6 is a side view of the electrical connector in FIG. 1.
Figure 7:
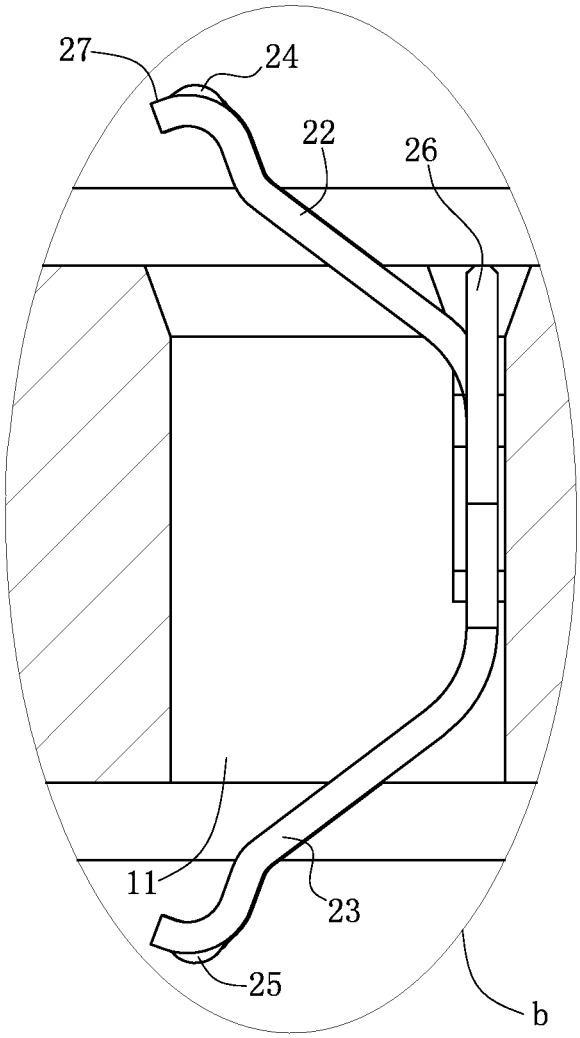
FIG. 7 is an enlarged view of a part b in FIG. 6.
Figure 11:
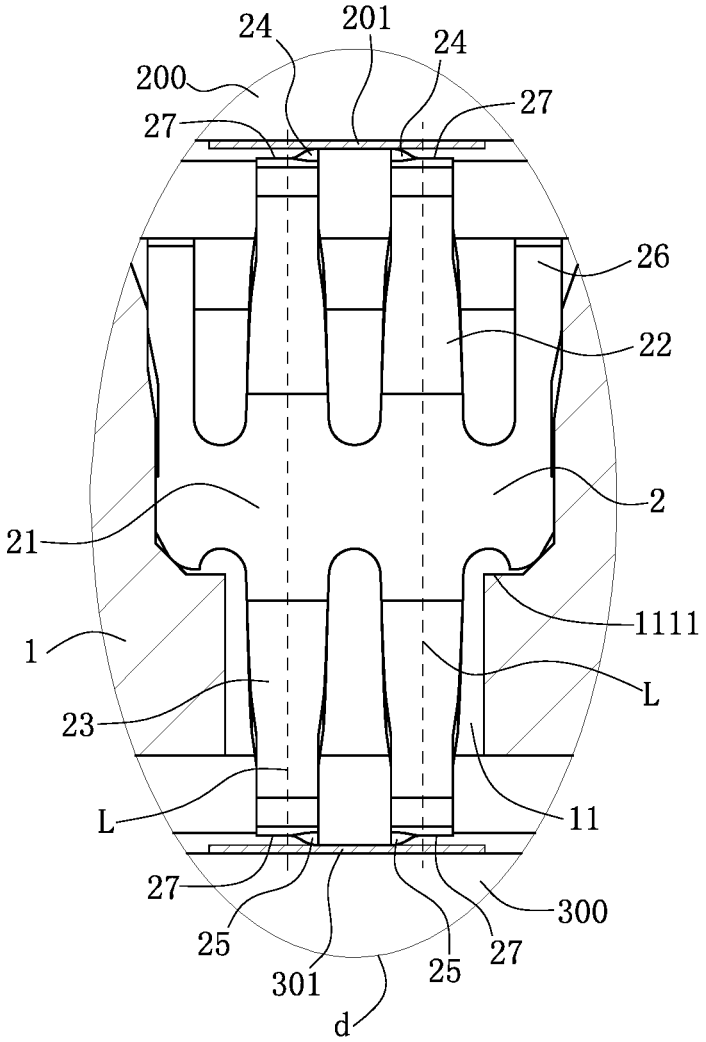
FIG. 11 is an enlarged view of a part d in FIG. 10.

As shown in FIG. 1, FIG. 5, and FIG. 11, each of the terminals 2 has a flat plate-shaped connecting portion 21. Two adjacent elastic arms 22 are formed by bending and extending upward from the connecting portion 21, and two adjacent conducting arms 23 are formed by bending and extending downward from the connecting portion 21.

The inner sides of the two adjacent elastic arms 22 are protrudingly provided with two contact portions 24 upward. Opposite outer sides of the two adjacent elastic arms 22 and opposite outer sides of the two adjacent conducting arms 23 are provided with two notches 27 respectively. The two notches 27 located at the two adjacent elastic arms 22 are respectively connected to the two contact portions 24. In other words, each of the two elastic arms 2 has one of two contact portions 24 and one of the two notches 27, so that each contact portion 24 is located higher than an upper surface of each of the elastic arms 22. The outer side of each elastic arm 22 is spaced from each of the contact portions 24.

A bottom surface of the chip module 200 has multiple circular conductive sheets 201. The two contact portions 24 upward abut a same one of the conductive sheets 201.

A contour of the contact portion 24 is a semicircle, and a height of each of the contact portions 24 gradually decreases along a direction from the inner side of the elastic arm 22 to the outer side of the elastic arm 22. An inner side edge of each of the contact portions 24 is flush with an inner side edge of each of the two elastic arms 22 correspondingly. Each elastic arm 22 has a center line L along an extension direction thereof, and each contact portion 24 is located at one side of the center line L. In this way, the contact portions 24 cannot easily slide out from the conductive sheet 201. Therefore, a risk that the terminals 2 and the chip module 200 are not conducted with each other is reduced, thereby ensuring stable contact between the electrical connector 100 and the chip module 200.

The two notches 27 located at the two adjacent elastic arms 22 respectively penetrate through the corresponding elastic arms to ends of the two adjacent elastic arms 22. Moreover, each of the two notches 27 respectively crosses the corresponding center line L, and partially penetrates through the corresponding elastic arm 22 to the inner side of the corresponding elastic arm 22.

The inner sides of the two adjacent conducting arms 23 are protrudingly provided with two abutting portions 25 downward, and as opposite outer sides of the two adjacent conducting arms 23 are provided with the two notches 27 correspondingly, so that each of the abutting portions 25 is located lower than a lower surface of each of the two adjacent conducting arms 23, and the outer side of each of the two adjacent conducting arms 23 is spaced from each of the abutting portions 25.

A top surface of the circuit board 300 has multiple conductive spacers 301, and the two abutting portions 25 downward abut a same conductive spacer 301.

Each of the two abutting portions 25 and each of the two contact portions 24 have the same structure. An inner side edge of each of the two abutting portions 25 is flush with an inner side edge of each of the two adjacent conducting arms 23. Each of the two adjacent conducting arms 23 has the center line L, and each of the two abutting portions 25 is located at one side of the center line L. In this way, the two abutting portions 25 cannot easily leave the spacer 301. Therefore, a risk that the terminals 2 and the circuit board 300 are not conducted with each other is reduced, thereby ensuring stable contact between the electrical connector 100 and the circuit board 300.

The two notches 27 located at the two adjacent conducting arms 23 respectively penetrate through the corresponding conducting arms 23 to ends of the two adjacent conducting arms 23. Moreover, each of the two notches 27 respectively crosses the center line L, and partially penetrates through the corresponding conducting arm 23 to the inner side of the corresponding conducting arm 23.

A flat plate-shaped retaining portion 26 is formed by extending from each of two opposite sides of the connecting portion 21. When the terminal 2 is assembled into the corresponding accommodating hole 11 from top to bottom, the retaining portion 26 is retained in the retaining groove 111 of the insulating body 1. The stopping surface 1111 is located below the retaining portion 26, to prevent the terminal 2 from moving downward.

Each elastic arm 22 is exposed from an upper surface of the insulating body 1. The contact portions 24 abut the conductive sheets 201. The conducting arms 23 are exposed from a lower surface of the insulating body 1. The abutting portions 25 abut the conductive spacers 301. The notches 27 are spaced from the conductive sheets 201 and the conductive spacers 301 in a vertical direction.

Figure 12:
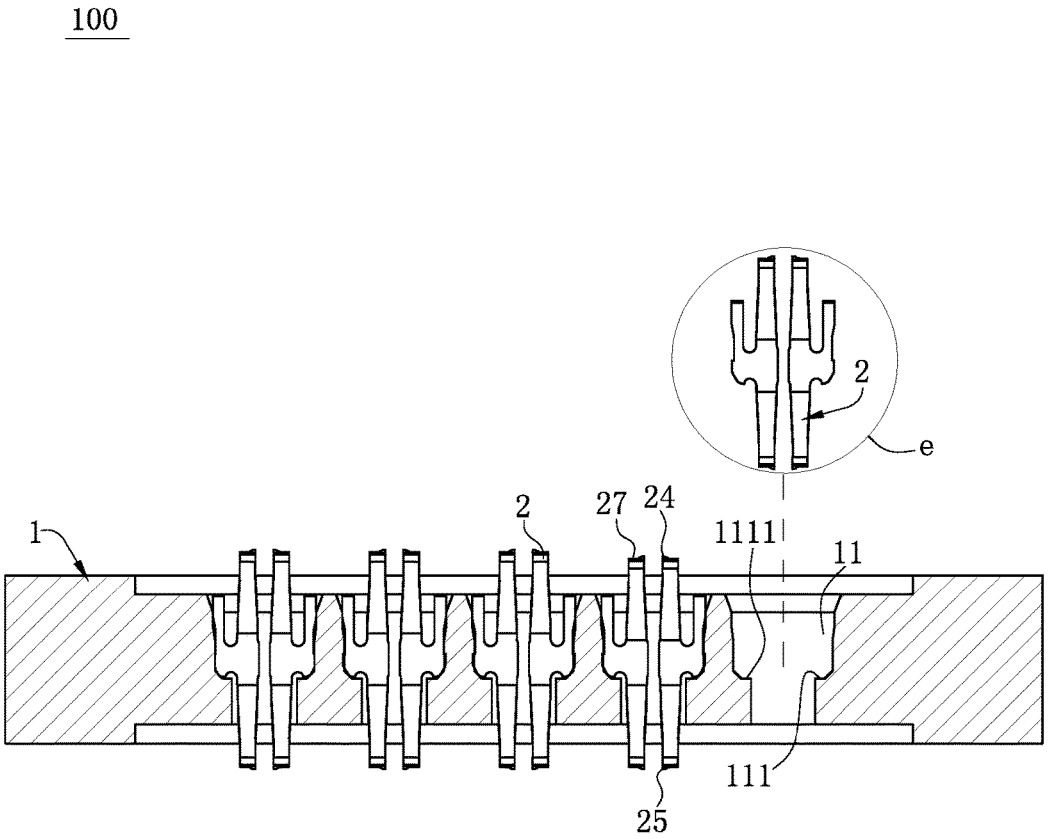
FIG. 12 is a planar cross-sectional view of an electrical connector according to a second embodiment of the present invention.
Figure 13:
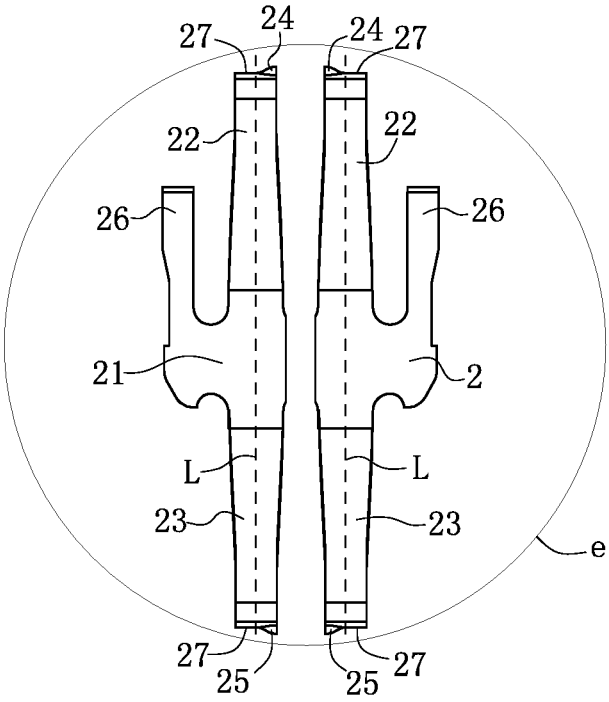
FIG. 13 is an enlarged view of a part e in FIG. 12.

FIG. 12 and FIG. 13 show a second embodiment of the electrical connector 100 in the present invention. The second embodiment differs from the first embodiment in that: each of the accommodating holes 11 accommodates two terminals 2 disposed at an interval; and each of the two terminals 2 is provided with an elastic arm 22 and a conducting arm 23. The two terminals 2 accommodated in one of the accommodating holes 11 upward contact a same one of the conductive sheets 201 and downward contact a same one of the conductive spacers 301.

Figure 14:
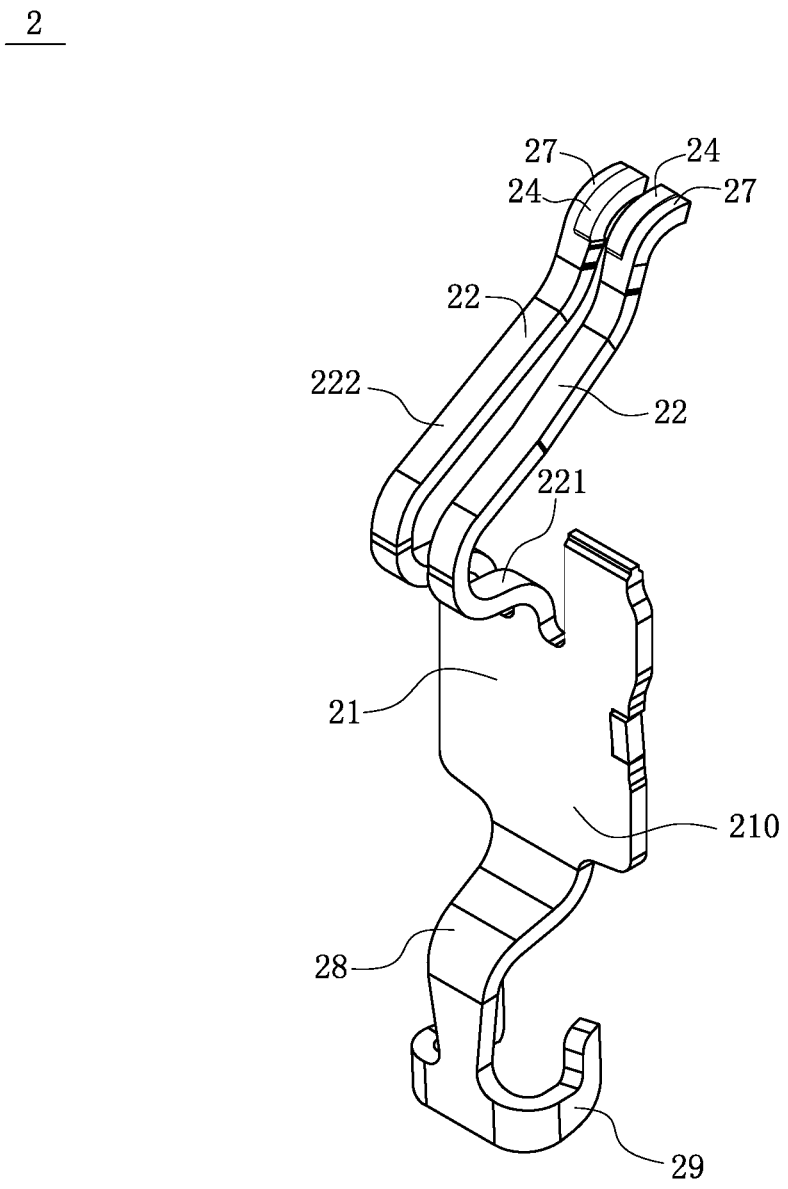
FIG. 14 is a perspective view of a terminal of an electrical connector according to a third embodiment of the present invention.
Figure 15:
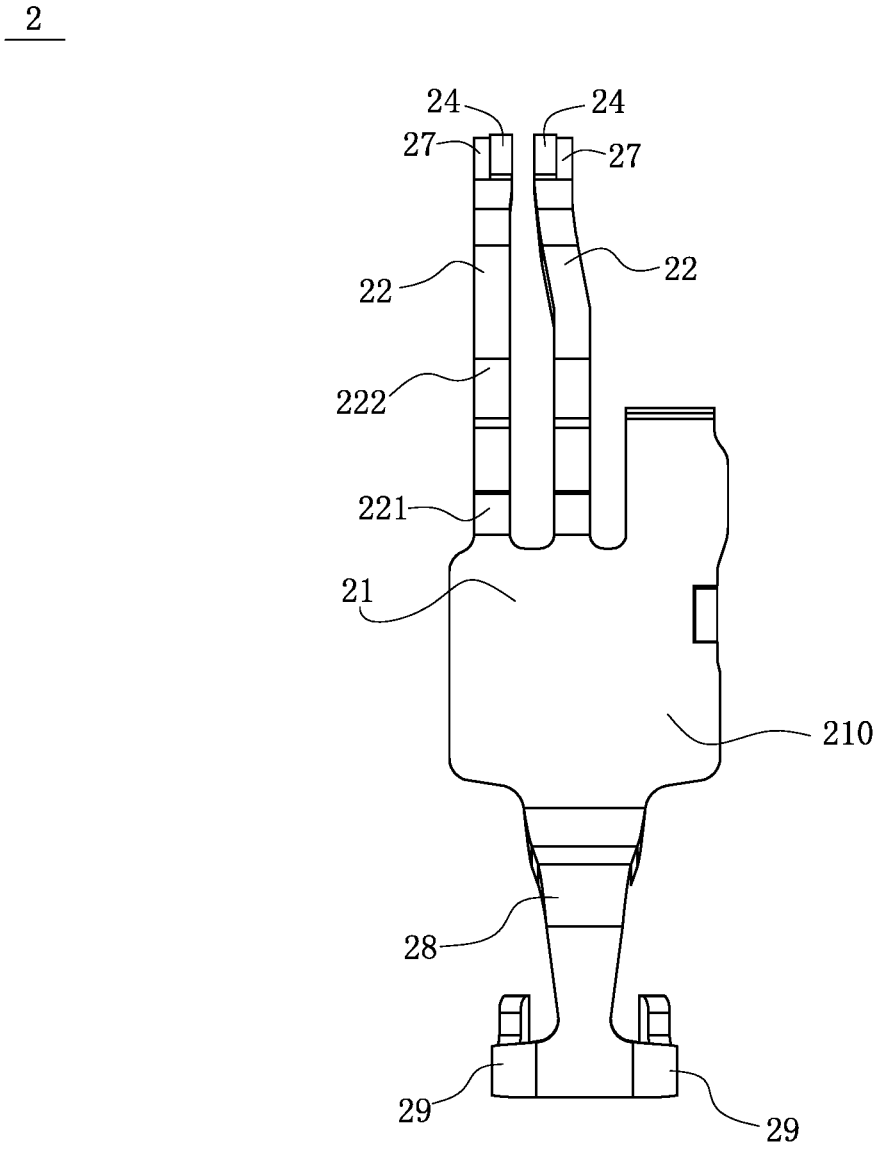
FIG. 15 is a front view of the terminal in FIG. 14.

FIG. 14 and FIG. 15 show a terminal 2 according to a third embodiment of the present invention. This terminal 2 differs from the terminal 2 in the first embodiment in that: the terminal 2 has a flat plate-shaped connecting portion 21; the connecting portion 21 has a vertical plane 210; and two elastic arms 22 are formed by bending and extending upward from the connecting portion 21 and adjacent to each other.

Each of the elastic arms 22 includes a first arm 221 and a second arm 222. The first arm 221 is bent and extends upward from the connecting portion 21 in a direction away from the vertical plane 210. The second arm 222 is formed by extending upward from the first arm 221 in a direction toward and across the vertical plane 210. One of the second arms 222 is bent toward another one of the second arms 222, so that a distance between the two elastic arms 22 decreases in a direction from bottom to top.

Inner sides of the two adjacent second arms 222 are protrudingly provided with two contact portions 24 upward. The two contact portions 24 respectively extend to free ends of the two second arms 222, and widths of the contact portions 24 are the same. Bottom surfaces of the two notches 27 are parallel to upper surfaces of the two contact portions 24.

A bending arm 28 is formed by bending and extending downward from the connecting portion 21. The bending arm 28 and the first arm 221 are located at a same side of the vertical plane 210. A width of the bending arm 28 gradually decreases in a direction from top to bottom. Two clamping portions 29 horizontally extend from two opposite sides of a bottom portion of the bending arm 28 and are configured to clamp a solder (not shown in the figures).

Figure 16:
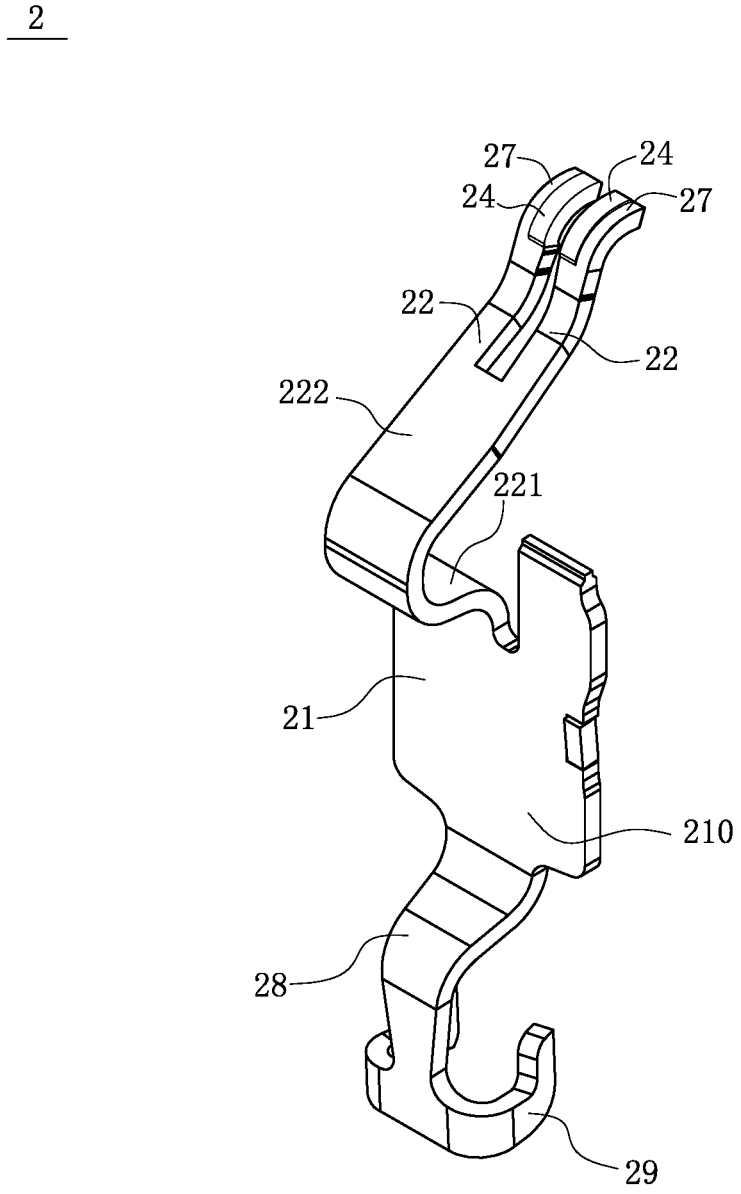
FIG. 16 is a perspective view of a terminal of an electrical connector according to a fourth embodiment of the present invention.

FIG. 16 shows a terminal 2 according to a fourth embodiment of the present invention. This terminal 2 differs from the terminal 2 in the third embodiment in that: an intersection of the two elastic arms 22 is not at the connecting portion 21. Certainly, in other embodiments, the free ends of the two adjacent elastic arms 22 may be connected to each other by a bridging portion (not shown in the figure).

Figure 17:
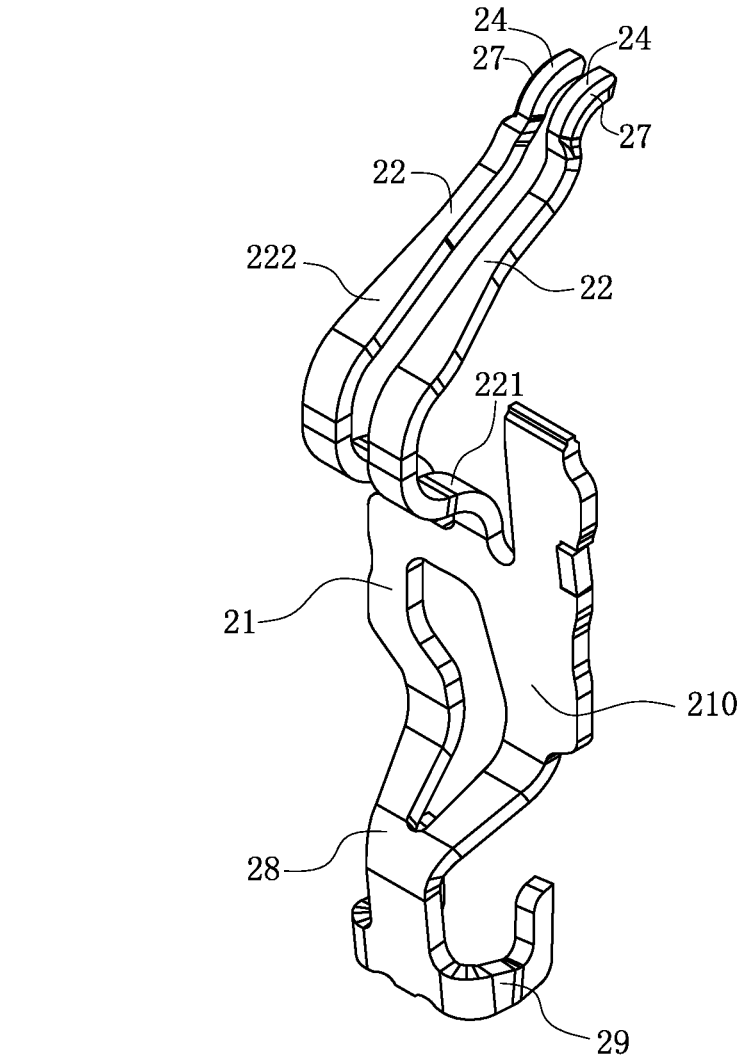
FIG. 17 is a perspective view of a terminal of an electrical connector according to a fifth embodiment of the present invention.
Figure 18:
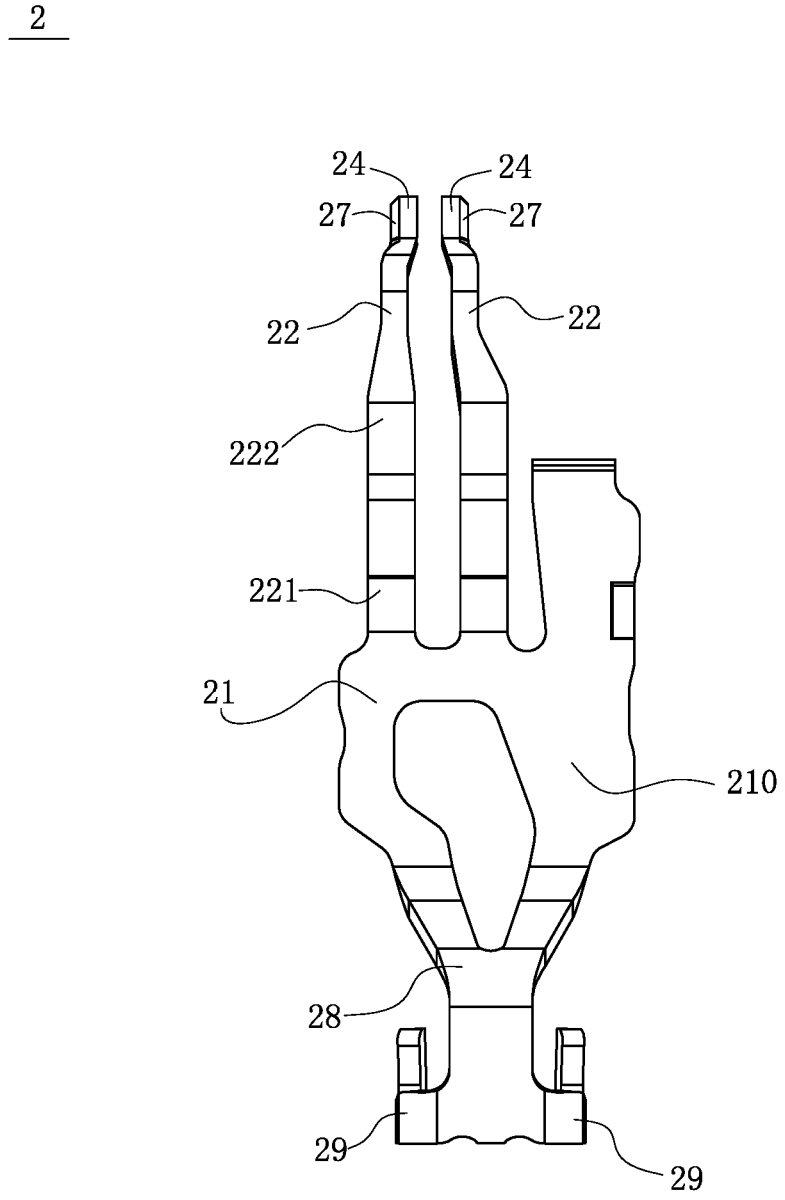
FIG. 18 is a front view of the terminal in FIG. 17.

FIG. 17 and FIG. 18 show a terminal 2 according to a fifth embodiment of the present invention. This terminal 2 differs from the terminal 2 in the third embodiment in that: the bottom surfaces of the two notches 27 are respectively and correspondingly connected to the upper surfaces of the two contact portions 24 in an inclined manner.

Figure 19:
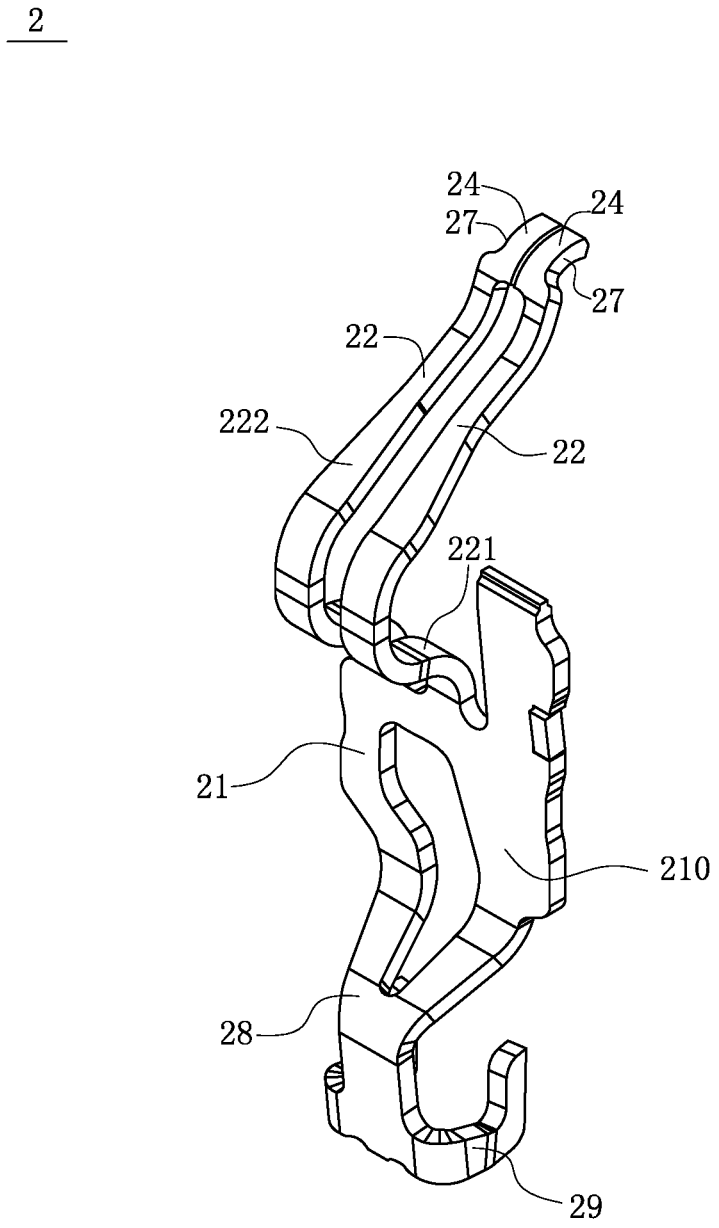
FIG. 19 is a perspective view of a terminal of an electrical connector according to a sixth embodiment of the present invention.
Figure 20:
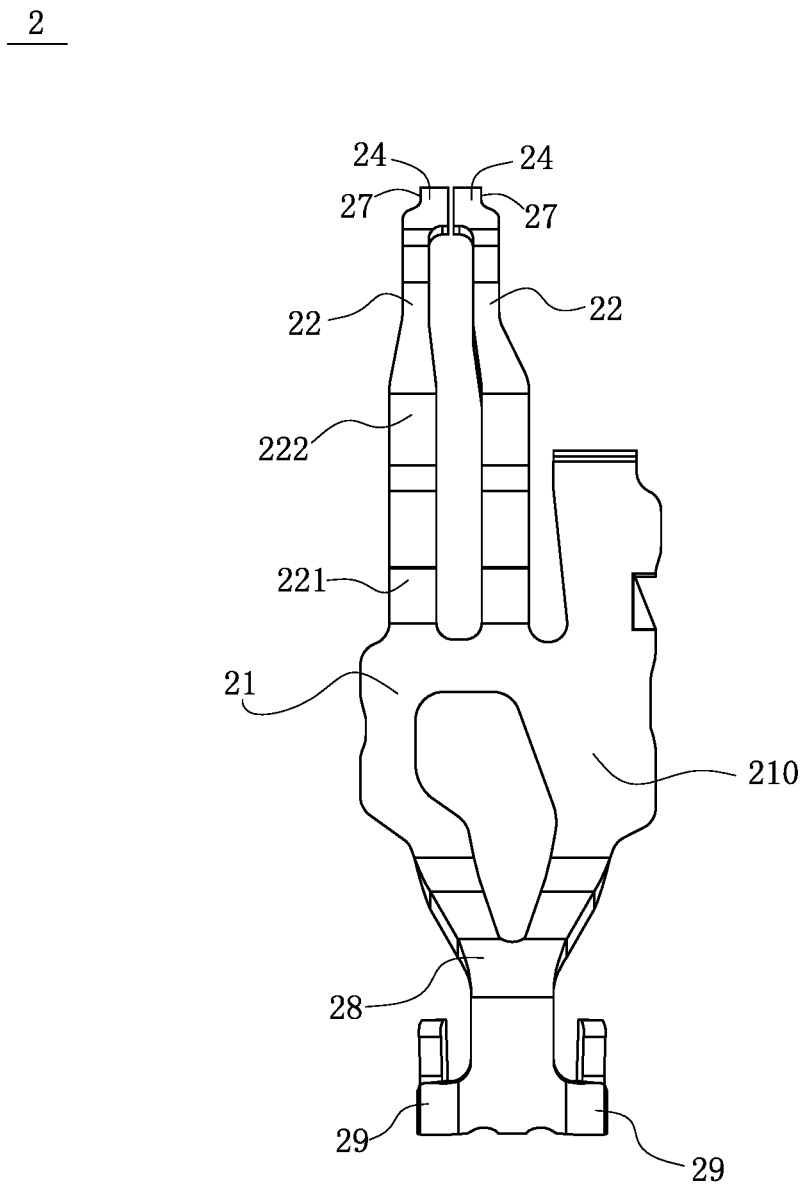
FIG. 20 is a front view of the terminal in FIG. 19.

FIG. 19 and FIG. 20 show a terminal 2 according to a sixth embodiment of the present invention. This terminal 2 differs from the terminal 2 in the third embodiment in that: the two second arms 222 further extend inward, and the two notches 27 respectively and correspondingly penetrate through the two second arms 222 in a vertical direction.

Figure 21:
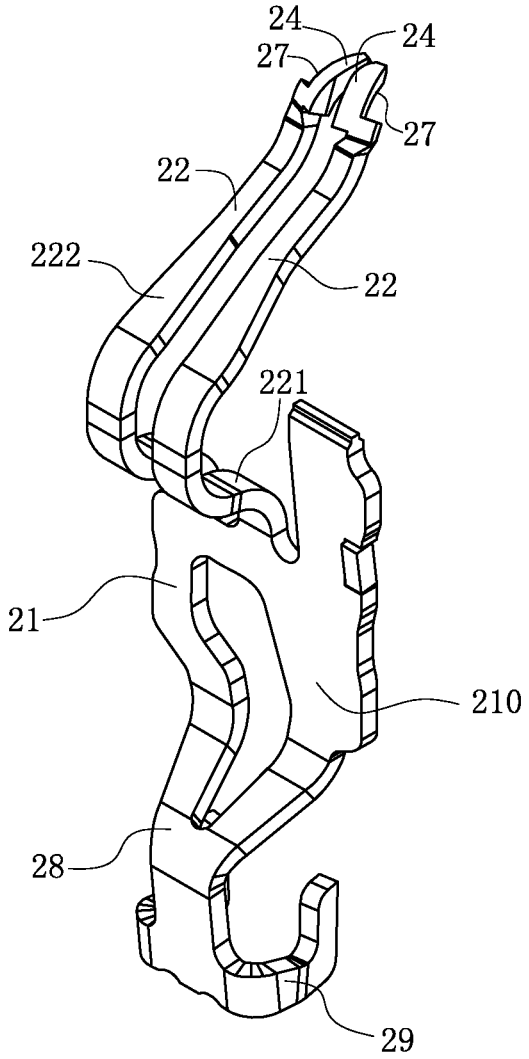
FIG. 21 is a perspective view of a terminal of an electrical connector according to a seventh embodiment of the present invention.
Figure 22:
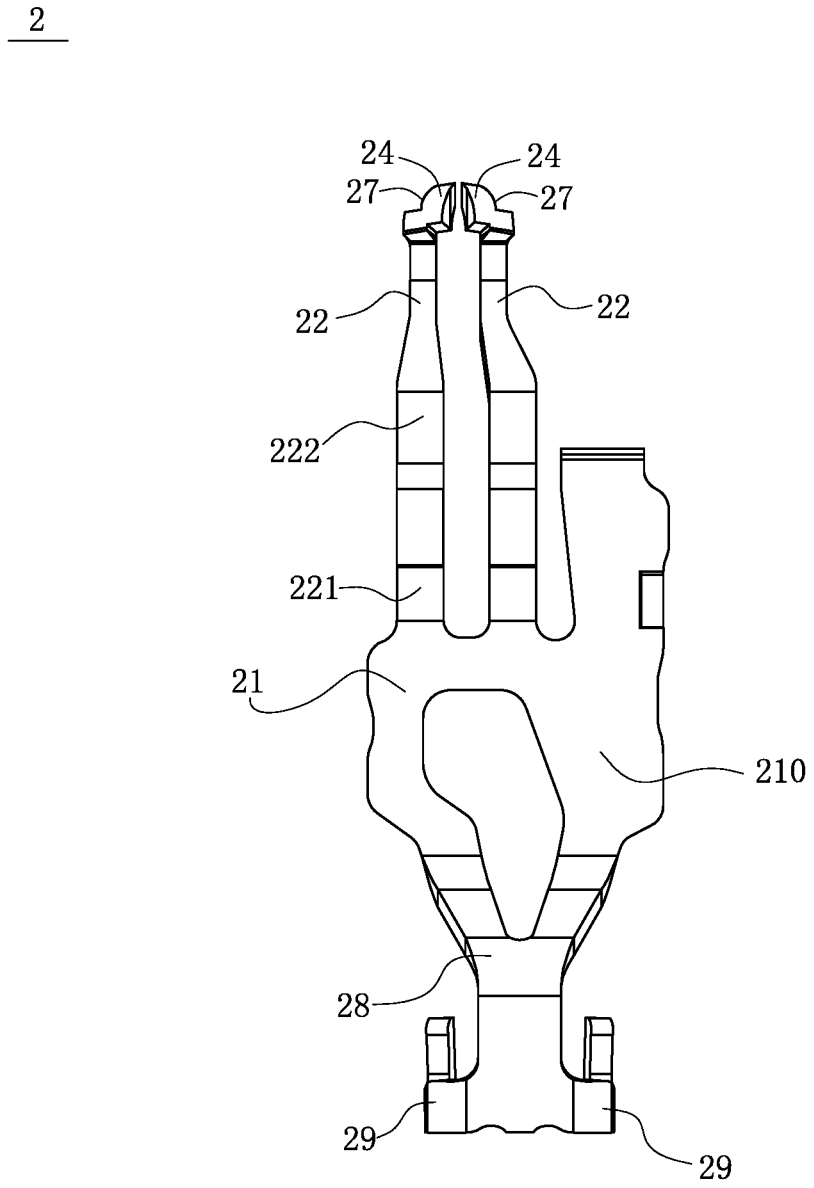
FIG. 22 is a front view of the terminal in FIG. 21.

FIG. 21 and FIG. 22 show a terminal 2 according to a seventh embodiment of the present invention. This terminal 2 differs from the terminal 2 in the sixth embodiment in that: the two second arms 222 are respectively folded outward to form the two contact portions 24.

To sum up, the electrical connector and the terminal according to certain embodiments of the present invention have the following beneficial effects:

(1) The two contact portions 24 are upward protrudingly provided at the inner sides of the two adjacent elastic arms 22 and abut the same conductive sheet 201. Therefore, a contact area between each terminal 2 and the conductive sheet 201 is small. In this way, the contact portions 24 cannot easily leave the conductive sheet 201, thereby preventing the contact portions 24 from being out of contact the conductive sheet 201 to avoid the outer side of each contact portion 24 sliding out from the conductive sheet 201 and abutting other components that are on the chip module 200 and that are lower than the conductive sheet 201. Therefore, a risk that the terminals 2 and the chip module 200 are not conducted with each other is reduced, thereby ensuring stable contact between the electrical connector 100 and the chip module 200.

(2) The two contact portions 24 are upward protrudingly provided at the inner sides of the two adjacent elastic arms 22 and abut the same conductive sheet 201, and the opposite outer sides of the two adjacent elastic arms 22 are provided with the two notches 27 that are respectively connected to the two contact portions 24. Therefore, a contact area between the terminal 2 and the conductive sheet 201 is small, so as to ensure that the contact portions 24 cannot easily slide out from the conductive sheet 201, thereby preventing the contact portions 24 from being out of contact with the conductive sheet 201 to avoid the outer side of each contact portion 24 sliding out from the conductive sheet 201 and abutting other components that are on the chip module 200 and that are lower than the conductive sheet 201. Therefore, a risk that the terminal 2 and the chip module 200 are not conducted with each other is reduced.

(3) The height of each of the contact portions 24 gradually decreases along a direction from the inner side of the elastic arm 22 to the outer side of the elastic arm 22, so that a position at which each contact portion 24 is in contact with the conductive sheet 201 is located at the inner side of each of the elastic arms 22, thereby further ensuring that the contact portions 24 cannot easily leave the conductive sheet 201, and further reducing the risk that the terminal 2 and the chip module 200 are not conducted with each other.

(4) One of the second arms 222 is bent toward another one of the second arms 222, so that the distance between the two second arms 222 decreases in a direction from bottom to top, thereby further ensuring that the contact portions 24 cannot easily leave the conductive sheet 201, and further reducing a risk that the terminal 2 and the chip module 200 are not conducted with each other.

(5) The two second arms 222 are respectively folded outward to form the two contact portions 24, so that a position at which each contact portion 24 is in contact with the conductive sheet 201 is located at the inner side of each second arm 222, thereby further ensuring that the contact portions 24 cannot easily leave the conductive sheet 201, and further reducing a risk that the terminal 2 and the chip module 200 are not conducted with each other.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect to a chip module, wherein a bottom surface of the chip module is provided with at least one conductive sheet, the electrical connector comprising:

an insulating body, configured to sustain the chip module, and provided with at least one accommodating hole penetrating through the insulating body vertically; and at least one terminal, correspondingly accommodated in the at least one accommodating hole, and having at least two elastic arms, wherein two inner sides of two adjacent elastic arms of the at least two elastic arms are protrudingly provided with two contact portions upward, so that each of the contact portions is located higher than an upper surface of each of the two adjacent elastic arms, an outer side of each of the two adjacent elastic arms is spaced from each of the contact portions, and the two contact portions upward abut a same conductive sheet of the at least one conductive sheet.

2. The electrical connector according to claim 1, wherein each of the two adjacent elastic arms has a center line along an extending direction thereof, and each of the contact portions is provided at one side of the center line.

3. The electrical connector according to claim 1, comprising a plurality of terminals, wherein the two adjacent elastic arms are provided at two of the terminals.

4. The electrical connector according to claim 1, wherein:

each of the at least one terminal has a flat plate-shaped connecting portion;

the two adjacent elastic arms are formed by bending and extending upward from the connecting portion;

two conducting arms are formed by bending and extending downward from the connecting portion;

inner sides of the two conducting arms are protrudingly provided with two abutting portions downward, so that each of the abutting portions is located lower than a lower surface of each of the conducting arms;

an outer side of each of the conducting arms is spaced from each of the abutting portions; and the two abutting portions downward abut a same conductive spacer of a circuit board.

5. The electrical connector according to claim 4, wherein each of the abutting portions and each of the contact portions have a same structure.

6. The electrical connector according to claim 4, wherein a flat plate-shaped retaining portion is formed by extending from each of two opposite sides of the connecting portion, each of two opposite sides of each accommodating hole is concavely provided with a retaining groove, and the retaining groove has a stopping surface located below the retaining portion to prevent each of the terminals from moving downward.

7. The electrical connector according to claim 4, wherein each of the conducting arms has a center line along an extending direction thereof, and each of the abutting portions is provided at one side of the center line.

8. The electrical connector according to claim 1, wherein a contour of each of the contact portions is a semicircle.

9. The electrical connector according to claim 1, wherein a height of each of the contact portions gradually decreases along a direction from the inner side of the corresponding elastic arm to the outer side of corresponding elastic arm.

10. The electrical connector according to claim 1, wherein the inner side of each of the two adjacent elastic arms is flush with an inner side of each of the contact portions.

11. The electrical connector according to claim 1, wherein each of the contact portions extends to an end of each of the two adjacent elastic arms.

12. The electrical connector according to claim 1, wherein at least one of the two adjacent elastic arms is bent toward another one of the two adjacent elastic arms, so that a distance between the two adjacent elastic arms decreases in a direction from bottom to top.

13. A terminal, configured to electrically connect to a chip module, wherein multiple conductive sheets are provided on a bottom surface of the chip module, the terminal comprising:

two elastic arms, wherein two adjacent inner sides of the two elastic arms are provided with two contact portions, the two contact portions upward abut a same conductive sheet of the conductive sheets, opposite outer sides of the two elastic arms are provided with two notches respectively, and the two notches are respectively connected to the two contact portions.

14. The terminal according to claim 13, wherein each of the two elastic arms has a center line along an extending direction thereof, and each of the contact portions is provided at one side of the center line.

15. The terminal according to claim 13, wherein at least one of the two elastic arms is bent toward another one of the two elastic arms, so that a distance between the two elastic arms decreases in a direction from bottom to top.

16. The terminal according to claim 13, wherein each of the notches penetrates through the corresponding elastic arm to an end of the corresponding elastic arm.

17. The terminal according to claim 16, wherein each of the contact portions extends to the end of the corresponding elastic arm.

18. The terminal according to claim 13, wherein each of the notches penetrates through the corresponding elastic arm in a vertical direction.

19. The terminal according to claim 13, wherein a bottom surface of each of the notches is inclined to an upper surface of the corresponding contact portions.

20. The terminal according to claim 13, wherein the two elastic arms are folded outward to form the two contact portions.

* * * * *